United States Patent [19]

Eugenio

[11] Patent Number: 5,046,408

[45] Date of Patent: Sep. 10, 1991

[54] HOODED EXHAUST VENT

[76] Inventor: John Eugenio, 74 Chimney Hill Dr., Cambridge, Ontario, Canada

[21] Appl. No.: 552,017

[22] Filed: Jul. 13, 1990

[51] Int. Cl.[5] ..... F24F 13/10

[52] U.S. Cl. ..... 98/119; 137/572.6

[58] Field of Search ..... 98/116, 119, 42.09, 98/42.12; 34/235; 137/527.6, 527

[56] References Cited

U.S. PATENT DOCUMENTS

| | | | |
|---|---|---|---|
| 93,294 | 8/1869 | Frisbie | 137/527 |
| 586,618 | 7/1897 | Noll | 137/527 |
| 735,912 | 8/1903 | Schrotz | 137/527 X |
| 2,224,494 | 12/1940 | White | 98/119 |
| 2,741,972 | 4/1956 | Pryne | 98/119 |
| 2,800,853 | 7/1957 | Spear | 98/119 X |
| 3,250,206 | 5/2966 | Strouth | 98/119 |
| 3,791,281 | 2/1974 | Steiner | 98/42.09 |

*Primary Examiner*—Harold Joyce

[57] ABSTRACT

An air venting apparatus for use with air discharging blowers, fans, including an air outlet duct and flap valve which pivots at top of a hood. The flap valve closes the outlet end of the duct by gravity. One leaf spring clip which acts on the valve flap to retain the same in the closed position. The spring clip maintains enough force to retain the valve flap in the closed position against pressure differentials developed by the outside wind, but is fabricated to allow opening of the valve flap against pressure differentials developed by the air discharge blower (fan).

3 Claims, 2 Drawing Sheets

HOODED EXHAUST VENT

This invention is in relation to venting apparatus for the purpose of exhausting of air from the interior of a building or structure to the outside. It relates more to fan venting apparatus, as is used with laundry dryers, stoves, and venting of unwanted air conditions.

In searching for and reviewing U.S. Pat. Nos. 244,884/992,849/2,800,853/3,057,288/3,232,205 and 3,541,941 they were all found to be inpertinent to the invention described herein.

The types now in use have a flap valve which pivots at the top of vent housing and uses gravity to close. The flap is opened by the pressure produced by the fan or blower.

The gravity type flap, has a few disadvantages. In winter the flap valve freezes open against the vent housing. This is caused by the moisture in the air being exhausted and the freezing weather outside of the building. When the fan or blower is turned off the flap will remain frozen in the open position for days, until the weather gets warmer.

In this open position extremely cold air from the outside enters the interior of the building. In this open position small animals and birds will enter the vent ducting system and make nest in the ducts of the vent system. Also with the gravity type flap there is not enough pressure to keep small animals and birds from opening the flap.

Another disadvantage with gravity type flap valve is that when a pressure differential is created by wind movement outside, the flap valve will open even with the fan or blower turned off. When the pressure differential equalizes the flap valve drops into the closed position against seating area on the vent assembly thereby producing a chattering noise. This chattering noise repeats itself many times as the wind outside increases and decreases. Many attempts have been made to eliminate the above mentioned problems by the use of magnets, various spring arrangement, and different weights but results were unsatisfactory. Weights, springs, and magnets do not prevent the flaps from freezing up, nor do they eliminate the chattering noise. Also the springs used became stronger in pressure as the fan or blower were turned on, thereby restricting proper operation of the flap valve. Also with these types of venting flaps there is no adjustment to the amount of pressure applied on the flap valve.

To summarize, the spring and/or weights and/or magnets do not prevent freezing of flap valve and do not provide a positive means of closing flap valve while still allowing for proper vent flap operation.

This invention provides an effective solution to the freezing up problem and to the chattering noise, as well as keeping small birds and animals out. It provides closing pressure on flap valve yet still allows for proper operation of the venting system. This is achieved by using a flat spring clip and a screen which is specially made and a unique means of fastening.

The spring clip is not a coiled spring but a flat leaf spring which is specially sprung and shaped to provide proper pressure against the flap valve. This spring pressure allows for blower operation to open the vent flap but still maintains enough pressure to keep flap valve in the fully closed position even against differential pressures created by the wind. The construction of the spring clip prevents the flap valve from coming in contact with the vent hood or housing, thereby preventing the flap from freezing to the housing or hood.

Furthermore pressure created by the spring clip keeps the flap valve from producing chattering noise when there is a change in differential pressure around or at the vent assembly, and helps to keep small birds and animals from lifting valve plate.

Unique construction of screen allows the screen to be installed on different size hood vent openings, and unique clips provide easy installation and removal. Accordingly, the primary object of this invention is to provide a valved air venting apparatus which keeps the valve in the closed position when fan or blowers rae not in operation, and to prevent valve from freezing open against the vent assembly housing and keep small birds and animals out of the venting system. This invention accomplishes the above while at the same time allows valve to operate properly under various conditions with regard to pressure changes on exterior and interior of venting apparatus.

Another object of the invention is to provide venting apparatus as aforesaid which utilizes spring clip means disposed in operative relation to the valve to retain valve in the closed position, said spring clip slides over hood and requires no means of fastening.

An additional object of the invention is to provide venting apparatus as aforesaid which utilizes spring clip means to prevent valve from freezing open.

A further object of the invention as aforesaid is the means of incorporation of specially made screen onto hood assembly, fastened with unique clips and not allow any accumulation of lint with regard to screen.

The foregoing and other objects of the invention will appear more clearly after an examination of the following specifications and accompanying drawings.

EMBODIMENT

Figure 1:
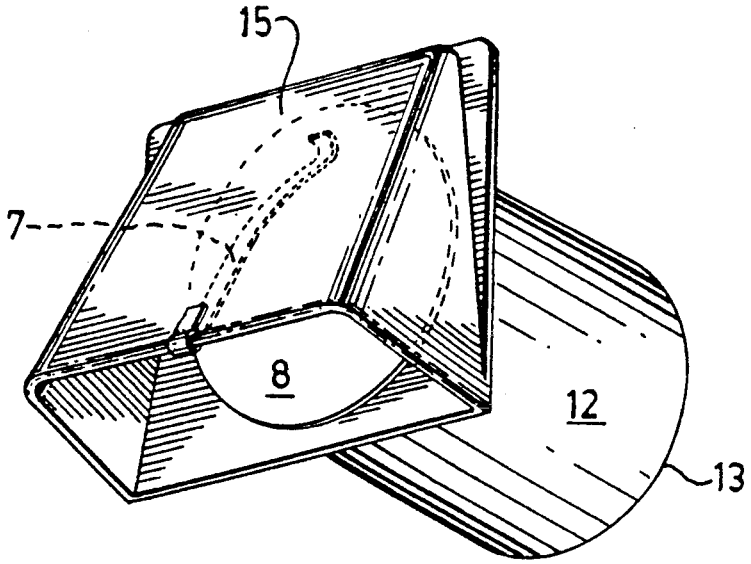
FIG. 1 is a perspective view of the present invention showing the novel spring clip 7 retaining the flap valve 8 in the closed position against face plate of vent assembly.
Figure 2:
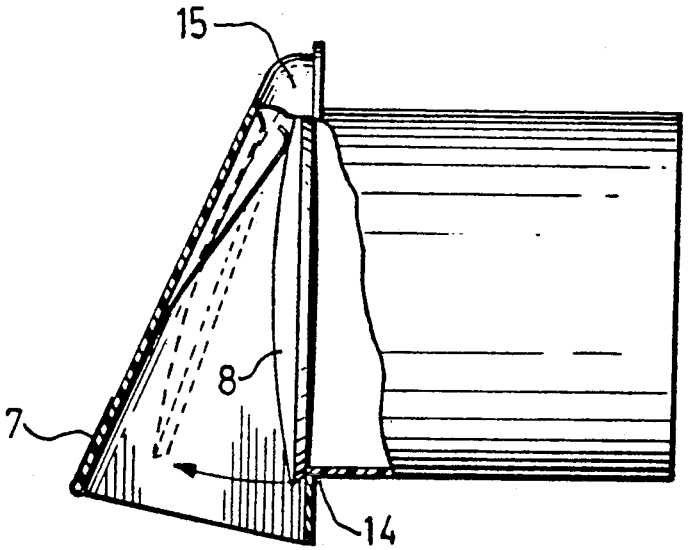
FIG. 2 is the side elevational view, showing position of spring clip 7 and area of contact on flap valve 8. Also shows both open and closed position of flap valve 8.

One embodiment in a venting apparatus of the invention is shown in FIG. 1 wherein it is illustrated, as part thereof, a cylindrically shaped duct 12 having a free end 13 which is positioned to extend inward through the exterior wall of building or structure to the interior.

wherein free end is connected by suitable means to the exhaust outlet of air blower or fan which is typically part of clothes dryer, stove, range, or any venting apparatus used for expelling unwanted air or the like. The other end 14 of duct 12 is part of outer face plate which in turn is fastened to exterior wall. An interior face plate not shown, of suitable outline, having an aperture therein to fit snugly over duct 12 is positioned thereon so as to be flush against the interior surface of building or structure.

The venting apparatus is further provided with a swingable flap valve plate 8, the upper end pivoting from upper end of face plate and housing. The valve plate 8 being circular in construction and of such dimensions as to close the opening of the duct 12 in the face plate 14 when flap valve 8 is in the closed position.

Further the venting apparatus is provided with special screen 18 which is placed onto opening on hood 15 and fastening by unique clips. Screen is lanced in 2 locations as to allow screen to fit on various hood openings.

An exterior hood 15 is also provided as part of vent assembly. The hood is sloping downwardly and outwardly from top edge of assembly as to provide space between hood 15 and outer face plate 14 wherein the flap valve 8 may be free to swing into the open position.

Figure 3:
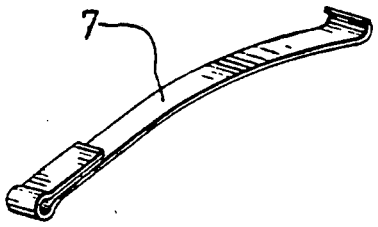
FIG. 3 is a side view of spring clip 7, outlining unique means of fastening.
Figure 4:
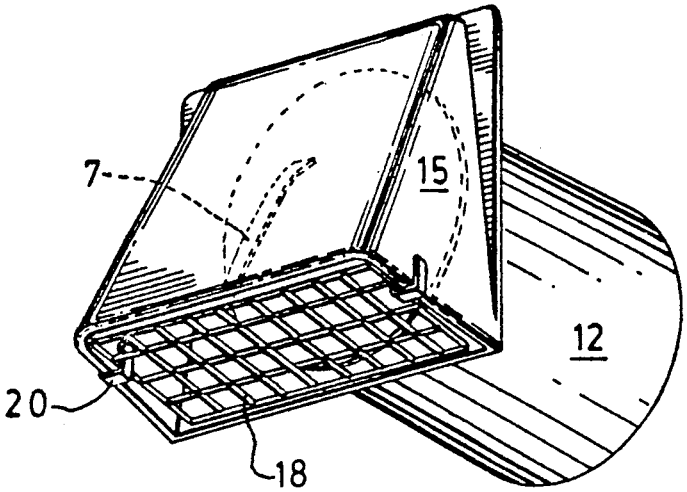
FIG. 4 is a perspective view of the present invention showing the novel screen in place or hood opening and spherical clips used for fastening. Some adhesive or silicone may be used. Screen can be moulded or cast as part of the vent body.
Figure 5:
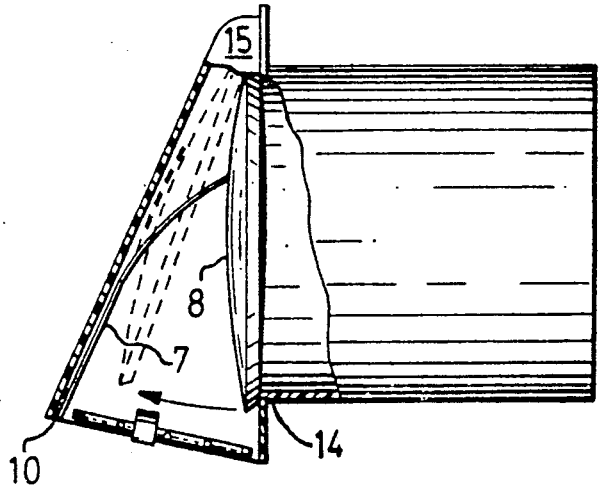
FIG. 5 is side elevational view, showing position of plastic spring clip 7 and area of contact on flap valve 8, open & closed position of flap 8.
Figure 6:
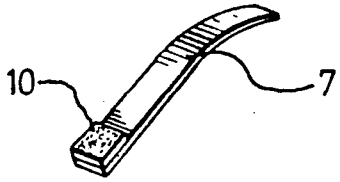
FIG. 6 is side view of plastic spring clip 7 outlining means of fastening. Double sided tape 10 or dab of contact glue. Plastic spring may be moulded as part of the vent body.
Figure 7:
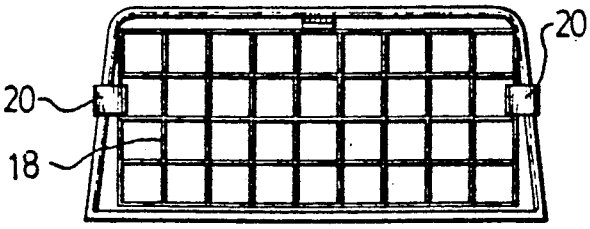
FIG. 7 is front view of screen which is specially made to fit various makes of vent hood assemblies and shows special clips 20 used to fasten screen to hood.

Construction of venting assembly of the invention may be of moulded plastic or shaped metals, examples being sheet metal, aluminum, or combination of metals and plastics. The spring clip 7 being of sprung metals or sprung plastics. The screen 18 being of non-rusting material and of grid size as to allow lint and dust to exit vent system. In order to retain the flap valve 8 of the venting apparatus in the closed position when fan or blower is turned off, the apparatus is provided with a unique spring clip 7. Spring clip may be fabricated of steel of plastic. Stainless steel is used and specially shaped as shown in FIG. 3 and then made to have spring characteristics. Unique spring clip 7 design allows spring clip to be fastened to hood 15 with no fastening device. If unique spring clip 7 is made of plastic material then it may be fastened to hood 15 by using contact glue, double sided tape or the like, may be moulded as part of the hood 15 assembly.

Unique spring clip 7 slides over the bottom edge of hood 15 with flat end of spring clip pointing up and inwardly into vent assembly, flat end of spring clip acts on outer side of flap valve 8 on or above the center position of flap valve 8.

While spring clip 7 is chosen so as to provide sufficient pressure to hold flap valve 8 in the closed position when fan or blower is turned off as to prevent flap valve movement due to pressure deferential created by wind, the spring clip still allows for proper venting operation when fan or blower is turned on. Presence of spring clip 7, between flap valve 8 and hood 15 prevents the freezing of the flap valve 8 to the hood 15. Further by bending the spring clip or changing the spring clip location of fastening along the bottom of the hood 15 a change in spring pressure occurs allowing for adjustment on the amount of pressure applied to the flap valve 8. This same spring pressure force and special screen prevents small animals and birds from entering the venting assembly.

Unique screen is made of mesh wire or plastic and specially made as to fit various hood assemblies. Non rusting material is preferred for longer life of screen. The special clips used to fasten screen allows for any installation and removal. Some adhesive material could be used e.g.: glue, silicone, caulking etc.

Herein has been disclosed an inexpensive, effective and adjustable venting apparatus. My invention has been shown and described in detail it will be understood that the present invention is subject to various changes and modifications which may be made from time to time without departing from the principles, or spirit of the invention.

Having set forth the nature of the invention what is claimed is:

1. An air venting apparatus for connecting to the exhaust outlet of a fan or blower, which fan or blower when in operation exhaust air from the interior of building or structure through an exhaust duct into the venting apparatus for discharge therefrom to exterior of building or structure, said venting apparatus comprising:

a. an air duct having an inlet end and an outlet end, said inlet end being connected to the exhaust duct for discharging air therethrough;

b. a hood communicating with the air duct discharge end, said hood having a lower outlet for the exhaust of air therefrom;

c. a hingedly suspended movable valve flap operatively connected to the upper portion of said hood for opening and closing said air duct discharge end, said valve flap having an inside face and an outside face, said valve flap inside face facing toward the air duct discharged end for closing said air discharge outlet by pivotable movement against said discharge end upon the absence of blower impelled air through said air duct; and d. a spring clip means comprising at least one leaf spring clip being made of plastic or metal fastened at the lower outlet of the hood, said valve flap outside face being in contact with and being subject to the pressure of said spring clip and outside atmosphere, said spring clip means operative in the absence of blower impelled air against the said inside face of said valve flap to hold said valve flap in its closed position regardless of any changes in pressure to which the said outside face of said valve flap may be subjected, spring clip acting at center or thereabout on outside face of said valve flap and out of the air stream, said spring clip means being inoperative to hold said valve flap in the presence of fan or blower air pressure against said inner side of said valve flap.

2. An air venting apparatus as defined in claim 1 wherein said spring clip means further includes said spring clip being moulded or cast as part of the hood.

3. An air venting apparatus as defined in claim 1 wherein a screen is made of metal or plastic, or other non-rusting material is positioned onto the hood lower outlet, the screen being either made as to allow screen to e used on different size of hood openings and fastened to hood by retaining clips which allow for easy installation and removal, or said screen being a screen which is moulded or cast as part of the hood.

* * * * *